US006736650B1

(12) United States Patent
Chen et al.

(10) Patent No.: US 6,736,650 B1
(45) Date of Patent: May 18, 2004

(54) ELECTRICAL CONNECTOR WITH TERMINAL RETENTION MECHANISM

(75) Inventors: I-Hsin Chen, Tu-chen (TW); Chien-Sen Huang, Tu-chen (TW); Zhi-Kai Guo, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/420,107

(22) Filed: Apr. 21, 2003

(30) Foreign Application Priority Data

Dec. 20, 2002 (TW) ..... 91220820 U

(51) Int. Cl.[7] ..... H01K 12/00

(52) U.S. Cl. ..... 439/79; 439/713; 439/718; 439/725

(58) Field of Search ..... 439/79, 83, 701, 439/712, 713, 718, 725, 752, 842

(56) References Cited

U.S. PATENT DOCUMENTS

| | | | | | |
|---|---|---|---|---|---|
| 5,194,019 | A | | 3/1993 | Rose | |
| 5,199,886 | A | * | 4/1993 | Patterson | 439/79 |
| 5,249,974 | A | * | 10/1993 | Wang | 439/79 |
| 5,252,080 | A | * | 10/1993 | Pesson | 439/79 |
| 5,256,072 | A | * | 10/1993 | Hatagishi | 439/79 |
| 5,340,320 | A | * | 8/1994 | Puerner | 439/79 |
| 5,346,404 | A | * | 9/1994 | Shimada | 439/108 |
| 5,451,158 | A | * | 9/1995 | Lin et al. | 439/79 |
| 5,453,016 | A | * | 9/1995 | Clark et al. | 439/79 |
| 5,531,604 | A | * | 7/1996 | Huang | 439/79 |
| 5,591,050 | A | | 1/1997 | Sueoka | |
| 5,630,730 | A | | 5/1997 | Wang et al. | |
| 5,639,249 | A | * | 6/1997 | Lenoir | 439/79 |
| 5,639,250 | A | * | 6/1997 | Neef et al. | 439/79 |
| 5,676,554 | A | * | 10/1997 | Tsuji | 439/79 |
| 5,692,912 | A | * | 12/1997 | Nelson et al. | 439/79 |
| 5,743,765 | A | * | 4/1998 | Andrews et al. | 439/608 |
| 5,785,537 | A | * | 7/1998 | Donahue et al. | 439/79 |
| 5,797,769 | A | | 8/1998 | Yang et al. | |
| 5,807,119 | A | * | 9/1998 | Baechtle et al. | 439/79 |
| 5,971,774 | A | * | 10/1999 | Kuki et al. | 439/79 |
| 6,077,092 | A | * | 6/2000 | Chiu et al. | 439/79 |
| 6,093,032 | A | * | 7/2000 | McHugh et al. | 439/79 |
| 6,183,270 | B1 | * | 2/2001 | Huang et al. | 439/79 |
| 6,404,652 | B1 | * | 6/2002 | Takebayashi et al. | 361/824 |
| 6,419,503 | B1 | * | 7/2002 | Choy | 439/79 |
| 6,447,307 | B1 | * | 9/2002 | Wu | 439/79 |
| 6,475,000 | B1 | * | 11/2002 | Hu et al. | 439/79 |

FOREIGN PATENT DOCUMENTS

| | | |
|---|---|---|
| TW | 234584 | 11/1994 |

* cited by examiner

*Primary Examiner*—Ross Gushi
(74) *Attorney, Agent, or Firm*—Wei Te Chung

(57) ABSTRACT

An electrical connector (1) includes a dielectric housing (10), a plurality of terminals (13) received in the housing, and a retention mechanism (12) pivotally attached to the housing. The housing defines a plurality of terminal-passages (108) and first mating members (103). Each of terminals includes a bent portion (134). The retention mechanism has an elongate stopper member (120). A pair of cantilevers (122) depends from the stopper member. A second mating member (1222) is formed on each of the cantilevers, for engaging one of the first mating members. Thus the stopper member is rotatable between a first position in which the stopper is protected from thermal warp or deformation, and a second position in which the terminals are secured in the corresponding terminal-passages.

18 Claims, 5 Drawing Sheets

ELECTRICAL CONNECTOR WITH TERMINAL RETENTION MECHANISM

BACKGROUND OF THE INVENTION

1. Field of the Invention

The present invention relates to an electrical connector, and more particularly to an electrical connector with a retention mechanism for securely retaining contacts of the connector in a housing of the connector.

2. Description of the Prior Art

A conventional electrical connector disclosed in U.S. Pat. No. 5,797,769 comprises a dielectric housing, and a plurality of contacts received in the housing. The housing defines a plurality of contact-passages therein. Each contact has a retention portion forming several barbs at opposite sides thereof. The barbs of the contact interfere with internal walls of the housing in the corresponding contact-passage so as to retain the contact in the housing. However, this kind of electrical connector is typically mated and un-mated with a complementary connector repeatedly over a period of time. The barbs of the contacts abut and abrade the walls of the contact-passages during mating and un-mating, so that after a time the contacts may be only loosely engaged in the corresponding contact-passages. Any such contact if pressed is liable to be easily displaced or to even drop out of the corresponding contact-passage when the connector is next mating with the complementary connector. Because of these difficulties, reliability of electrical transmission of the connector is reduced. Electrical connectors disclosed in U.S. Pat. Nos. 5,630,730, 5,591,050 and 5,194,019 have similar shortcomings.

In order to solve the above-mentioned problems, another electrical connector has been developed and is disclosed in Taiwan Patent Issue No. 234584. Referring to FIG. 5, the connector 6 comprises a dielectric housing 60, a plurality of contacts 62 received in the housing 60, and an elongate retention plate 8. Each contact 62 is secured firmly in a corresponding contact-passage 600 defined in the housing 60 by the retention plate 8 pressing upon a base portion 620 of the contact 62. Thus reliability of electrical transmission of the connector 6 is enhanced. In assembly of the retention plate 8 on the housing 60 of the connector 6, protrusion portions 80 of the retention plate 8 are guided into corresponding grooves 64 of the housing 6. A positioning block 82 of the retention plate 8 slides over a slant surface 680 at a cutout 68 defined in the housing 60, and is then received in an opening 66 defined in the housing 60 below the cutout 68. A bottom edge wall 61 of the housing 6 supports the retention plate 8. Thus the retention plate 8 is firmly assembled on the housing 60.

During the above-described assembly, the retention plate 8 deforms along the widthwise direction thereof as the positioning block 82 of the retention plate 8 slides over the slant surface 680 of the cutout 68. Elastic force generated from such deformation is substantial, and is liable to damage the housing 60 and the retention plate 8. This makes assembly of the connector 6 awkward and difficult, and frequently results in failed assembly and wastage. Additionally, when the electrical connector 6 is soldered onto a printed circuit board, the retention plate 8 is situated adjacent solder portions 622 of the contacts 62. Thus the retention plate 8 can easily sustain thermal warpage or deformation because of soldering heat. After the connector 6 is repeatedly mated with a complementary electrical connector, some contacts 62 are liable to be easily displaced within the corresponding contact-passages 600. If the retention plate 8 has sustained warpage or deformation, it can no longer assure reliable electrical connectivity of the connector 6.

Accordingly, there is a need to provide an improved electrical connector to avoid the above-mentioned problems.

SUMMARY OF THE INVENTION

Accordingly, a main object of the present invention is to provide an electrical connector having retention mechanism minimally susceptible to deformation.

Another object of the present invention is to provide an electrical connector having a retention mechanism able to avoid thermal warpage or deformation during soldering of the electrical connector onto a printed circuit board.

To fulfill the above-mentioned objections, an electrical connector with a retention mechanism is provided according to the present invention. The connector includes a dielectric housing, a plurality of terminals received in the housing, and a retention mechanism attached to the housing. The housing defines a plurality of terminal-passages and a mounting face, and forms first mating members at opposite lateral ends thereof. Each of the terminals is received in a corresponding terminal-passages, and has a bent portion. The retention mechanism comprises an elongate stopper member. A pair of cantilevers depends from opposite ends of the stopper member. A second mating member is formed at a distal end of each cantilever, for engaging one of the second mating members.

With this structure, in assembly of the electrical connector, each cantilever and the stopper member deform along respective longitudinal directions thereof, so that the stopper member is easily resiliently deformed and is minimally susceptible to deformation. Additionally, the stopper member is rotated between a first position in which the stopper member is furthest away from the mounting face and is protected from thermal warpage or deformation during soldering the electrical connector on a printed circuit board, and a second position in which the stopper member presses on the bent portions so as to retain the terminals in the corresponding terminal-passages.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
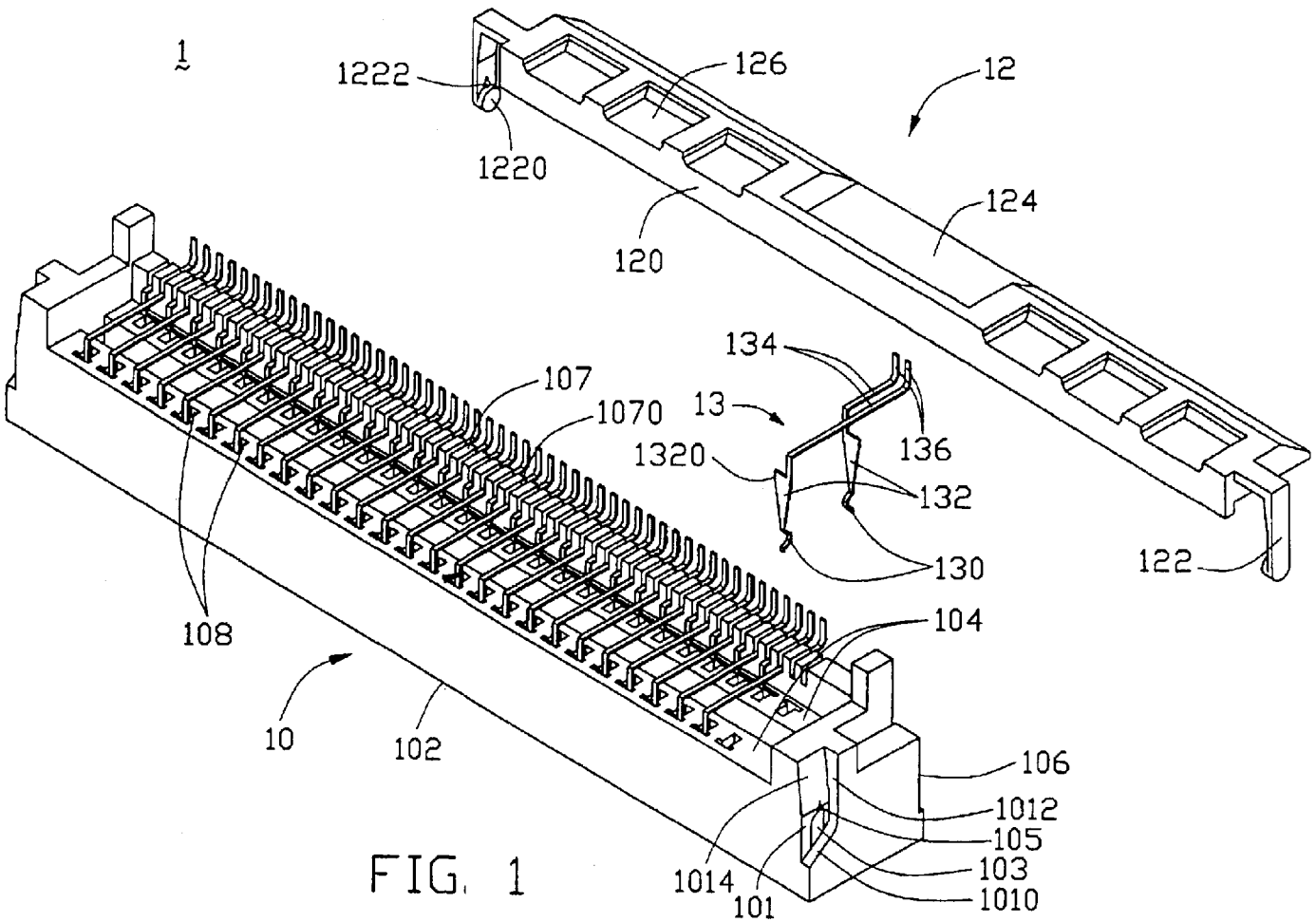
FIG. 1 is an exploded, isometric view of an electrical connector with a retention mechanism according to the present invention.

FIG. 1 shows an exploded, isometric view of an electrical connector 1 according to the present invention. The electrical connector 1 comprises an elongate dielectric housing 10, a multiplicity of terminals 13 received in the housing 10, and an elongate retention mechanism 12 rotatably attached to the housing 10.

The housing 10 is formed unitarily from a dielectric plastic material such as LCP (liquid crystal polymer) or ABS (acrylonitrile-butadiene-styrene). The housing 10 is formed with a mating face 102, a rear face 104 opposite to the mating face 102, and a mounting face 106 for mounting the electrical connector 1 on a printed circuit board (not shown). Top and bottom rows of terminal-passages 108 are defined between the mating face 102 and the rear face 104, for receiving corresponding terminals 13 therein. Two concavities 101 are defined in the housing 10 at opposite longitudinal ends thereof respectively. Each concavity 101 is bounded in part by a slanted first stopper surface 1010 and an adjoining non-slanted second stopper surface 1012, both of which are perpendicular to the rear face 104. A recessed first mating member 103 is defined in the housing 10 at an inner extremity of each concavity 101. A slant surface 1014 is formed on the housing 10 at said inner extremity of the concavity 101, between the first mating member 103 and the rear face 104. A semi-conical positioning recess 105 is defined in the housing 10 between the first mating member 103 and the slant surface 1014. The housing 10 is further formed with a rear wall 107. The rear wall 107 extends perpendicularly from the rear face 104 adjacent the mounting face 106. A plurality of slots 1070 is defined in the rear wall 107 in communication with corresponding terminal-passages 108, for receiving corresponding terminals 13 therethrough.

Each terminal 13 is received in a corresponding terminal-passages 108, and comprises a retention portion 132, a mating portion 130 extending from one end of the retention portion 132, and a bent portion 134 extending from an opposite end of the retention portion 132. A plurality of barbs 1320 is formed on opposite lateral edges of the retention portion 132, for securing the terminal 13 in the corresponding terminal-passage 108. The mating portion 130 is adapted to electrically interconnect with a mating contact of a complementary electrical connector (not shown). The bent portion 134 extends outside the corresponding terminal-passage 108. A soldering portion 136 is bent perpendicularly from a bottom end of the bent portion 134, for soldering on the printed circuit board.

The retention mechanism 12 is rotatably attached to the housing 10, and comprises an elongate plate-shaped stopper member 120. A pair of cantilevers 122 depends from opposite longitudinal ends of the stopper member 120 respectively. Each cantilever 122 is formed with a generally discoid second mating member 1220 at an inside of a distal end thereof, the second mating member 1220 corresponding to a respective one of the first mating members 103 of the housing 10. A semi-conical positioning rib 1222 is formed on the cantilever 122 adjacent the second mating member 1220, corresponding to a respective one of the positioning recesses 105 of the housing 10. A central first cutout 124 is defined in the stopper member 120, for facilitating convenient manipulation of the stopper member 120 by a user. A plurality of second cutouts 126 is defined in the stopper member 120 at each of opposite sides of the first cutout 124. The second cutouts 126 help prevent warpage or deformation of the retention mechanism 12 due to internal stress therein.

Figure 2:
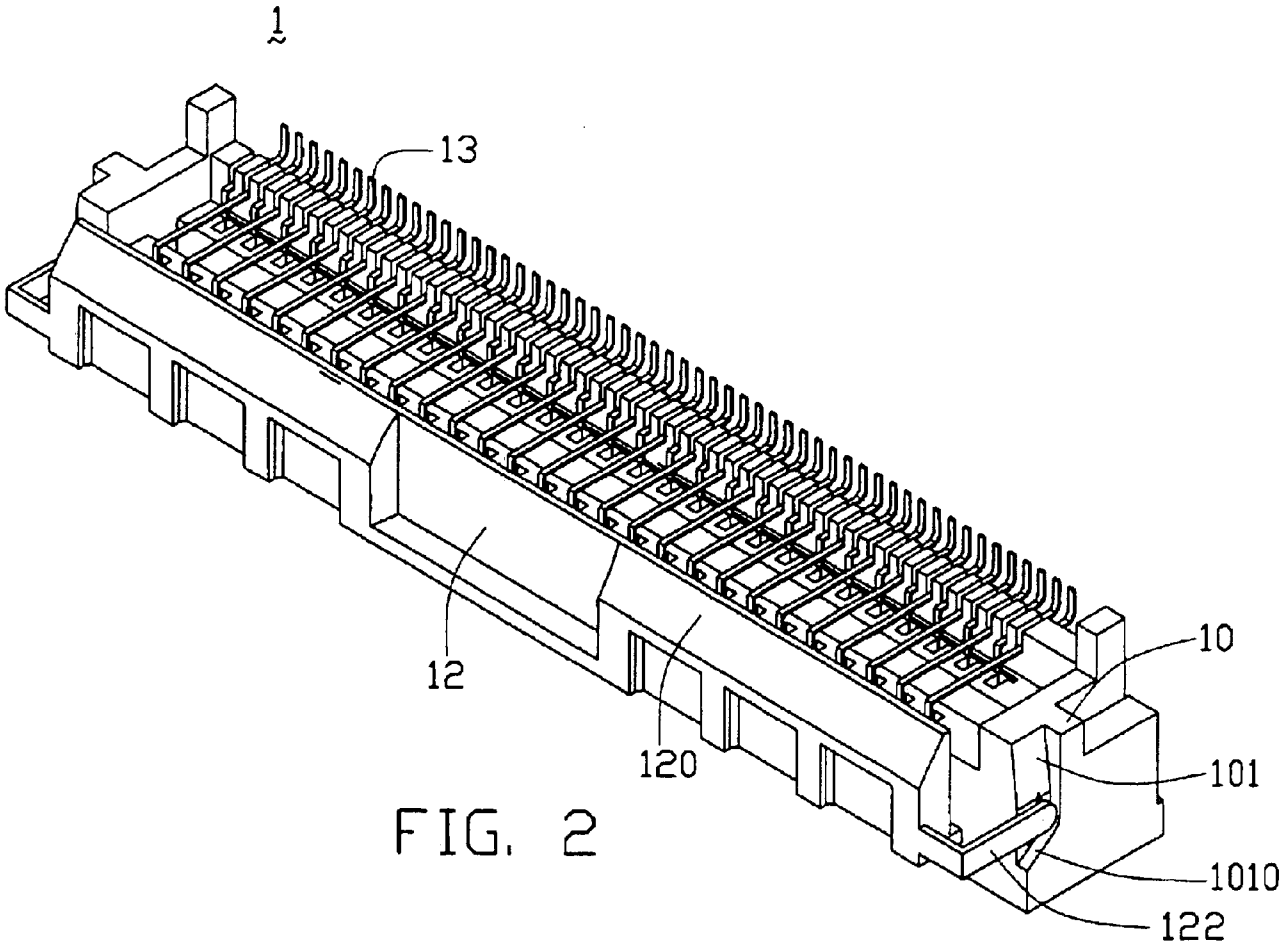
FIG. 2 is an assembled view of FIG. 1, showing the retention mechanism at a first position.

Referring also to FIG. 2, in assembly, the terminals 13 are secured in the top and bottom terminal-passages 108, with the barbs 1320 interfering with internal walls of the housing 10 in the corresponding terminal-passages 108. Bottom portions of the bent portions 134 are received in the corresponding slots 1070. Then the second mating members 1220 of the retention mechanism 12 are guided onto the slant surfaces 1014 of the housing 10 via the rear face 104. The second mating members 1222 are slid until they respectively snappingly mate with the first mating members 103. The retention mechanism 12 is thus assembled-onto the housing 10.

When the mechanism retention 12 is guided onto the housing 10 as described above, each of the cantilevers 122 and the stopper member 120 deform along respective longitudinal directions thereof, so that the stopper member 120 is easily resiliently deformed. Additionally, the slant surfaces 1014 minimize the deformation of the cantilevers 122 and the stopper member 120. Thus reduced force is needed to assemble the retention mechanism 12 onto the housing 10, making the assembly operation convenient.

Figure 3:
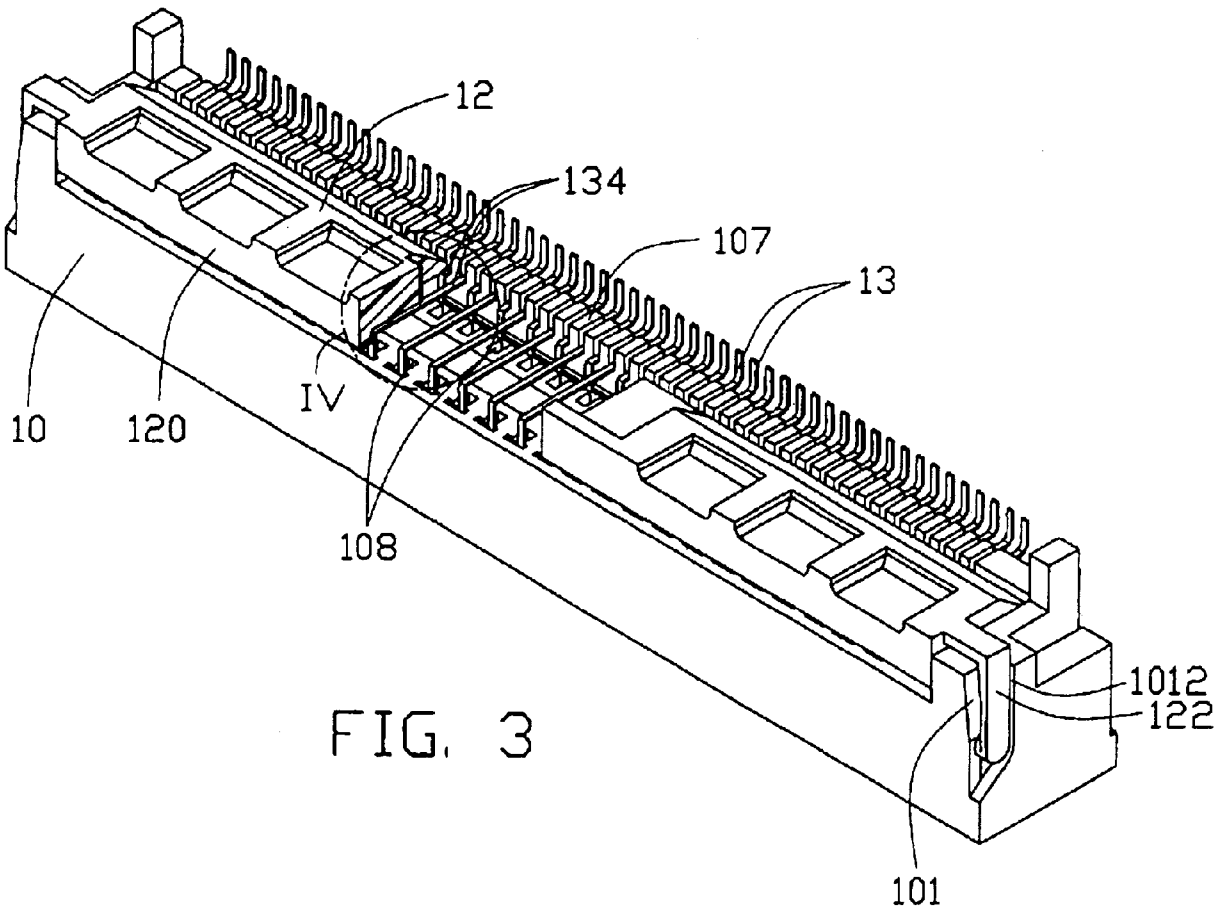
FIG. 3 is similar to FIG. 2, but showing the retention mechanism at a second position, and with part of the retention mechanism cut away.
Figure 4:
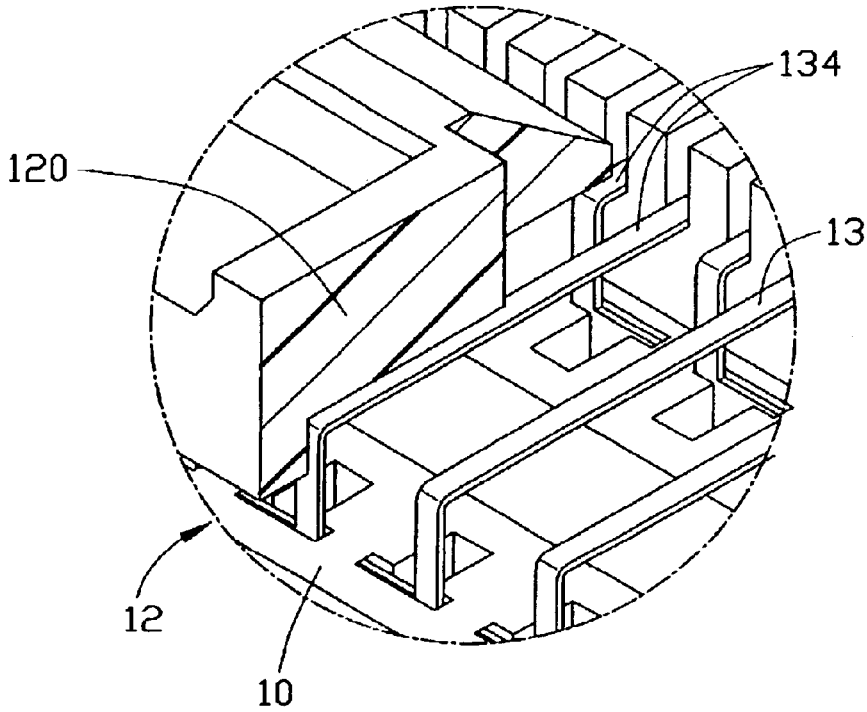
FIG. 4 is an enlarged view of a circled portion IV of FIG. 3.
Figure 5:
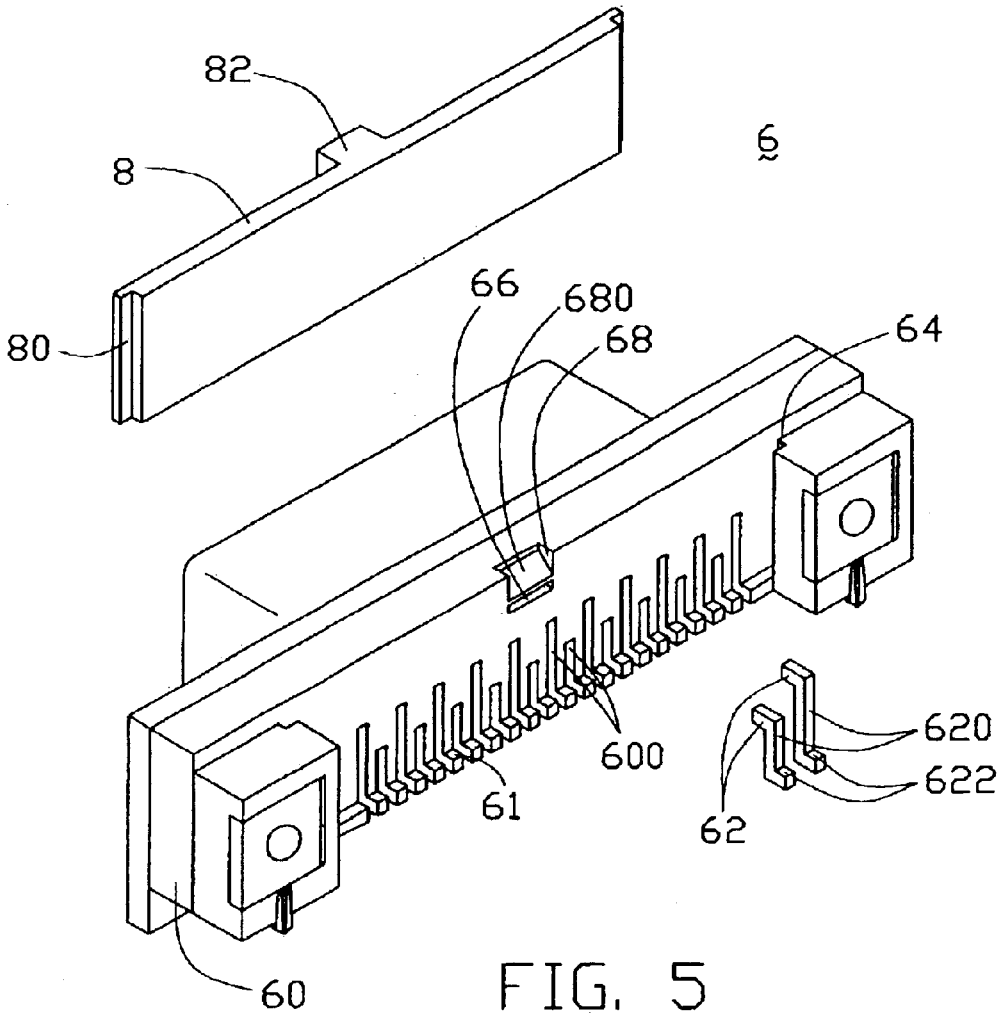
FIG. 5 (PRIOR ART)
FIG. 5 is a simplified, exploded isometric view of a conventional electrical connector.

Referring also to FIGS. 2, 3 and 4, in use, the stopper member 120 of the retention mechanism 12 is manually rotatable from a first position shown in FIG. 2 to a second position shown in FIG. 3. The retention mechanism 12 at the first cutout 124 is adapted to receive fingers of a user, to make the rotation operation easy and convenient. When the electrical connector 1 is soldered on, the printed circuit board, the stopper member 120 is located at the first position in which the stopper member 120 is furthest away from the mounting face 106. Thus the stopper member 120 is protected from thermal warpage or deformation due to heat generated from the soldering process.

After soldering, the stopper member 120 is rotated to the second position in which the stopper member 120 presses on the bent portions 134, thereby firmly retaining the terminals 13 in the corresponding terminal-passages 108. Simultaneously, the positioning ribs 1222 mate in the positioning recesses 105, thereby securing the stopper member 120 at the second position. As a result, all the terminals 13 are securely retained in the corresponding terminal-passages 108.

The above-described embodiment shows the retention mechanism 2 mating with the housing 10 by the recessed-first mating members 103 mating with the generally discoid second mating members 1220. It should be understood that alternative mating means between the retention mechanism 12 and the housing 10 may be adopted to attain the desired mechanical engagement. Various engagement means may be provided according to particular desired configurations of the housing 10 and the retention mechanism 12. It is also understood that the stopper member 120 may form the slots to restrainedly receive the bent portions 124 of the corresponding terminals 13 so as to more assure the true position of each terminal.

Further, although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical connector comprising:

a dielectric housing defining a plurality of terminal-passages, and a mounting face;

a plurality of terminals each received in a corresponding terminal-passage, and having a bent portion;

and a retention mechanism comprising an elongate stopper member, and a pair of cantilevers depending from the stopper member and pivotally attached to the housing to stop a movement of the terminals in the corresponding terminal-passages by the stopper member pressing on the bent portions of the terminals at at least one position of the stopper member.

2. The electrical connector of claim 1, wherein the at least one position of the stopper member is situated horizontal relative to the mounting face.

3. The electrical connector of claim 2, wherein the stopper member is rotatable between the at least one position of the stopper member and another position furthest away from the mounting face.

4. The electrical connector of claim 3, wherein the housing defines a pair of first mating members at opposite lateral ends thereof.

5. The electrical connector of claim 4, wherein the housing defines concavities at opposite lateral sides thereof, each of the concavities defining a slant surface, and a positioning recess.

6. The electrical connector of claim 5, wherein each of the first mating members is a recess defined in the housing at one of the concavity.

7. The electrical connector of claim 6, wherein the recess is in communication with the positioning recess.

8. The electrical connector of claim 7, wherein each of the cantilevers depends from one of longitudinal opposite ends of the stopper member.

9. The electrical connector of claim 8, wherein each of the cantilevers defines a second mating member thereon.

10. The electrical connector of claim 9, wherein the second mating member is a protrusion formed at a distal end of one of the cantilevers.

11. The electrical connector of claim 10, wherein each of the cantilevers defines a positioning rib, corresponding to one of the positioning recesses.

12. The electrical connector of claim 11, wherein the stopper defines a plurality of cutouts therein.

13. The electrical connector of claim 12, wherein each of the terminals comprises a retention portion having barbs, and a mating portion extending from one end of the retention portion.

14. The electrical connector of claim 13, wherein each of bent portions is substantially vertically bent at the other end of the corresponding retention.

15. An electrical connector comprising:

a dielectric housing defining a plurality of horizontal passageways and opposite mounting and upper faces, said mounting face located under said passageways and said upper face located above said passageways;

a plurality of terminals received in the corresponding passageways, respectively, each of said terminals defining a vertical bent portion exposed to an exterior around a rear face of the housing; and a retention mechanism pivotally mounted around the rear face of the housing and defining a pivot axis adjacent to said upper face, said retention mechanism including a stopper member forwardly abutting against the vertical bent portions of said terminals when said stopper member is rotated to a vertical assembly position while is allowed to be upwardly rotated away from the mounting face for preventing an improper heating situation.

16. The connector of claim 15, wherein said passageways are of two rows to receive two rows of said terminals, and said stopper member acts on both said two rows of the terminals.

17. The connector of claim 15, wherein said pivot axis is located far away from the rear face while close to a front face of the housing opposite to said rear face.

18. The connector of claim 15, wherein said housing further includes a horizontal rear wall adjacent to the mounting face and defining a plurality of slots to receive the vertical bent portions of the terminals therein, and a distal edge of the stopper member away from the pivotal axis is seated thereon.

* * * * *